US006317892B1

(12) United States Patent
Galigani

(10) Patent No.: US 6,317,892 B1
(45) Date of Patent: Nov. 20, 2001

(54) FOLDABLE HAT WITH STORAGE POCKET

(75) Inventor: Luca Galigani, Monsummano Terme (IT)

(73) Assignee: F.A.Co.Pel-Paola Bartolozzi-di Galigani Luca & C. S.N.C. (IT)

( * ) Notice: Subject to any disclaimer, the term of this patent is extended or adjusted under 35 U.S.C. 154(b) by 0 days.

(21) Appl. No.: 09/509,958

(22) PCT Filed: Oct. 2, 1998

(86) PCT No.: PCT/IT98/00264

§ 371 Date: Mar. 30, 2000

§ 102(e) Date: Mar. 30, 2000

(87) PCT Pub. No.: WO99/17627

PCT Pub. Date: Apr. 15, 1999

(30) Foreign Application Priority Data

Oct. 8, 1997 (IT) ..... FI970131 U

(51) Int. Cl.[7] ..... A42B 1/00
(52) U.S. Cl. ..... 2/209.11; 2/209.12
(58) Field of Search ..... 2/209.12, 175.1, 2/195.1, 171, 209.11

(56) References Cited

U.S. PATENT DOCUMENTS

| | | | | |
|---|---|---|---|---|
| 2,771,230 | | 11/1956 | Fitzpatrick . | |
| 4,165,542 | | 8/1979 | McLaughlin . | |
| 5,214,802 | * | 6/1993 | McCallum | 2/196 |
| 5,791,963 | * | 8/1998 | Lieberman | 446/27 |
| 5,799,335 | * | 9/1998 | Ethier | 2/209.11 |
| 5,991,916 | * | 11/1999 | Sierra | 2/12 |

FOREIGN PATENT DOCUMENTS

| | | |
|---|---|---|
| 2 085 257 A | 6/1994 | (CA) . |
| 40 40 442 A | 6/1992 | (DE) . |
| 2 741 241 A | 5/1997 | (FR) . |
| WO 8303527 A | 10/1983 | (WO) . |

* cited by examiner

*Primary Examiner*—Bibhu Mohanty
(74) *Attorney, Agent, or Firm*—McGlew & Tuttle P.C.

(57) ABSTRACT

The hat (2), made from a supple and foldable material, comprises a reversible pocket (5) made in said hat, into which the hat can be folded and stored when not in use.

6 Claims, 4 Drawing Sheets

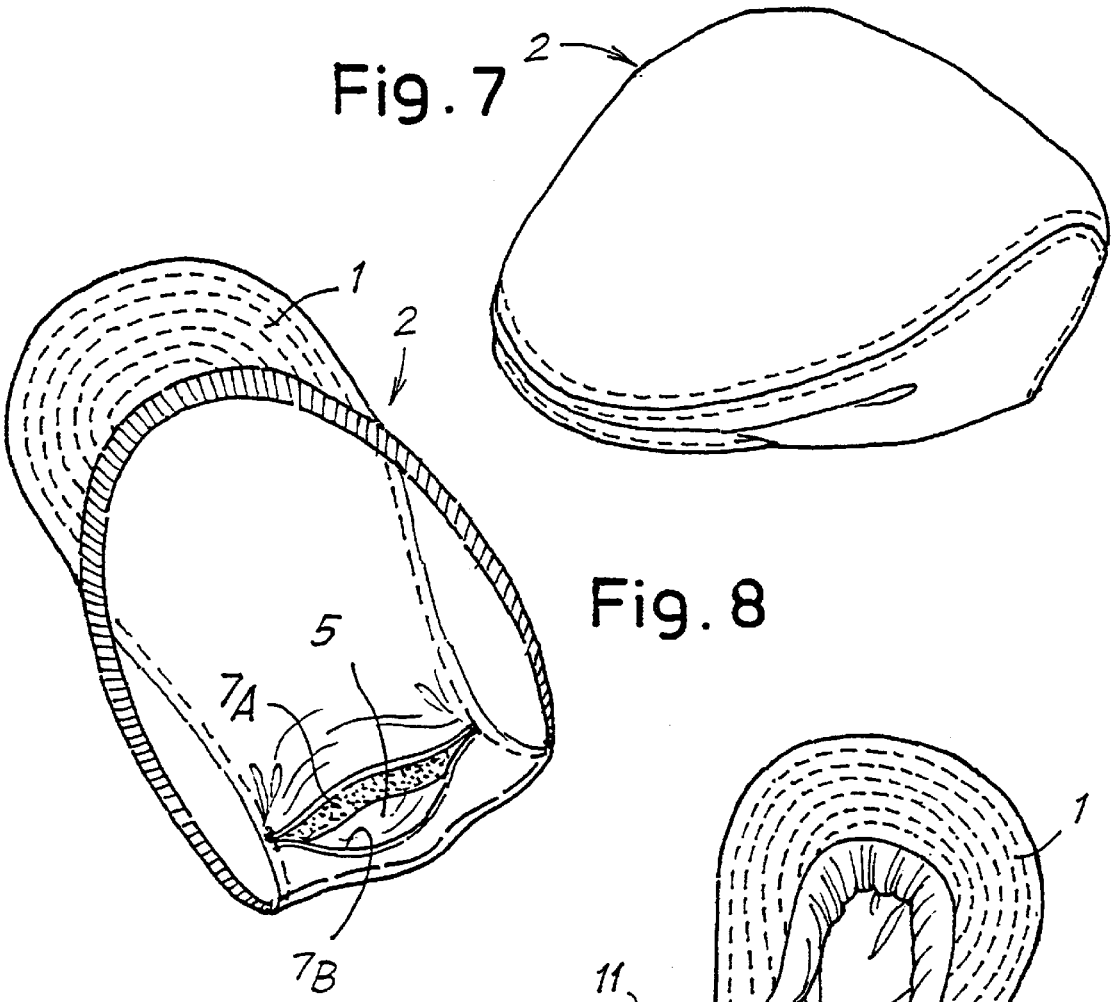
Fig. 7
Fig. 8
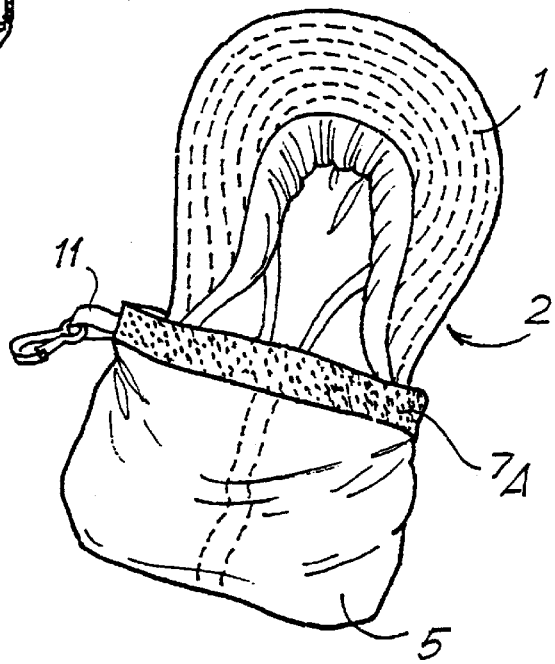
Fig. 9
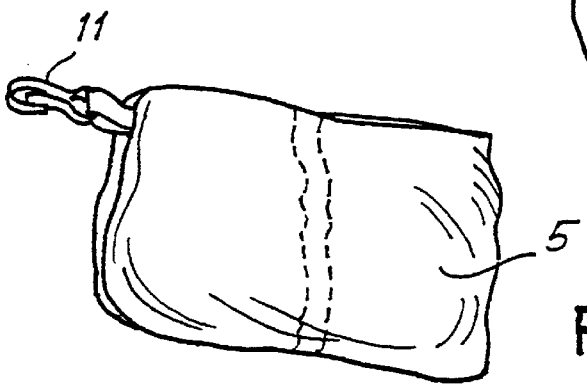
Fig. 10

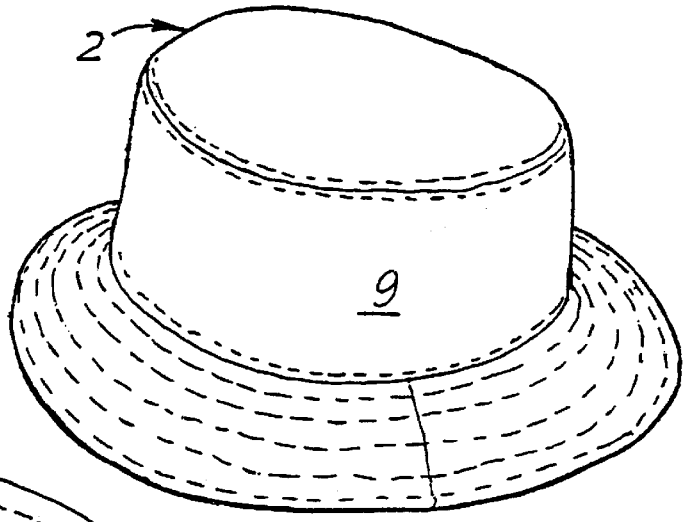
Fig. 11
Fig. 12
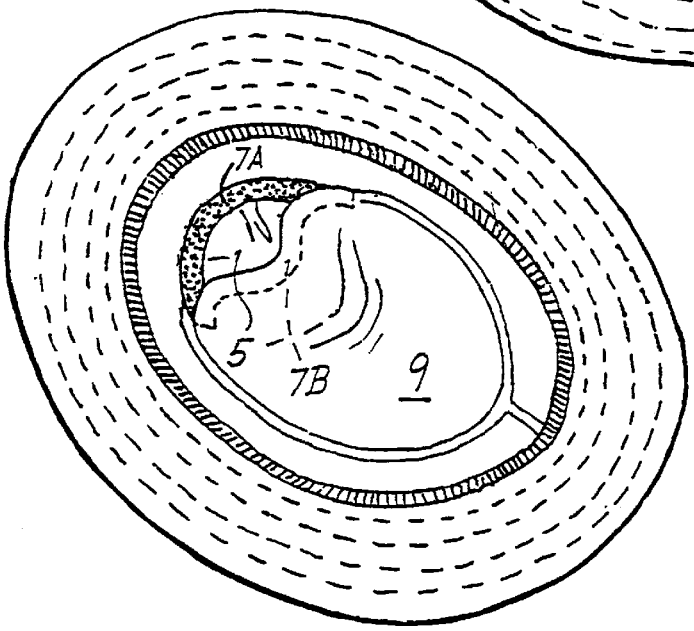
Fig. 13
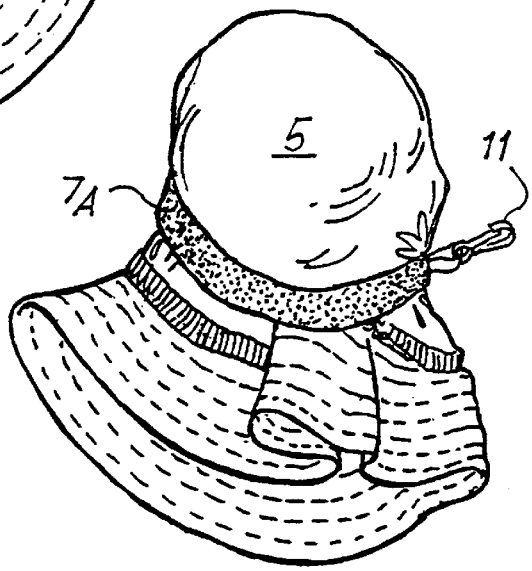
Fig. 14
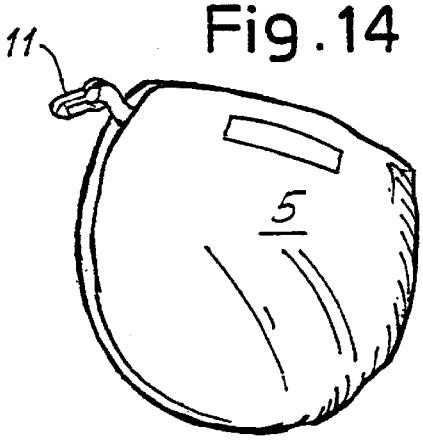

Fig. 15
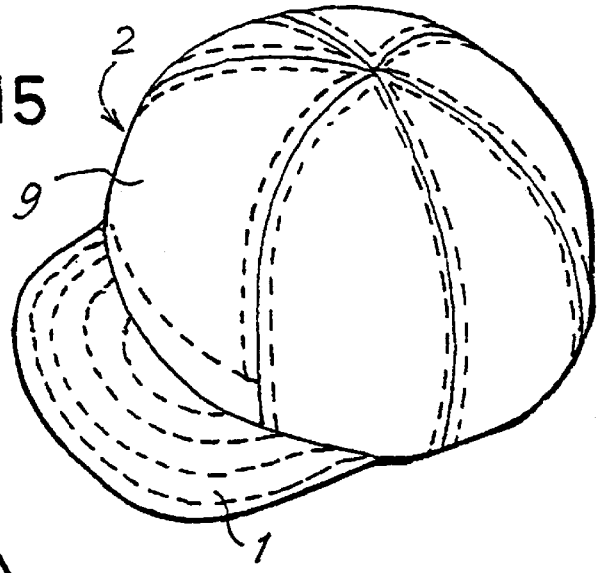
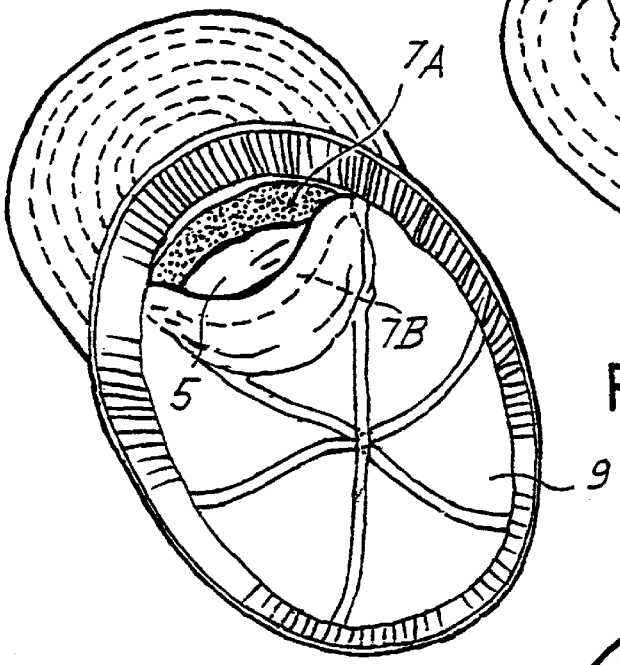
Fig. 16
Fig. 18
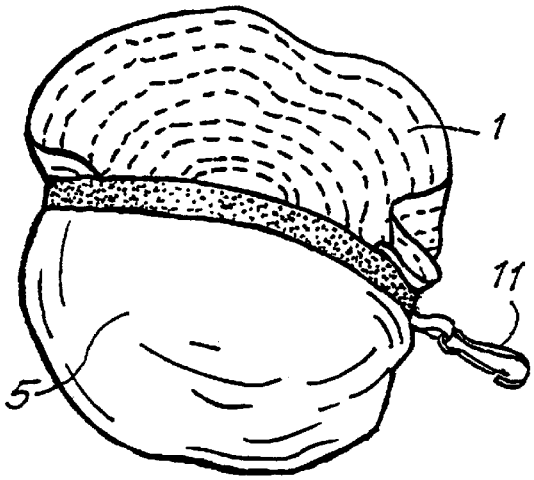
Fig. 17

FOLDABLE HAT WITH STORAGE POCKET

FIELD OF THE INVENTION

The present invention relates to a hat, in particular to a hat made from a soft and easily foldable material.

SUMMARY AND OBJECTS OF THE INVENTION

The object of the innovation is to produce a hat which is particularly comfortable and practical to wear. This is achieved, according to the innovation, with a hat made from a supple and foldable material, comprising a reversible pocket made from the material forming said hat or inside the latter, into which the hat can be folded and stored when not in use.

This enables a hat to be produced which is particularly comfortable and convenient to wear since it has a pocket in which small items can be stored. When not being worn, it can be folded into the reversed pocket, forming a small bag which can even form a key-case or the like, for example by stitching a spring clip or split ring or other suitable means for fastening keys or other objects, into the pocket.

The pocket is advantageously made in such a way that it has an opening on the inside of the hat, preferably along the edge of the central part of said hat. In this way the pocket is virtually invisible.

Advantageous embodiments of the invention are described below and given in the appended claims which form an integral part of the present description.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

The drawing shows practical embodiments of the invention and, more specifically:

BRIEF DESCRIPTION OF THE DRAWINGS

In the drawings:

FIGS. 7 to 10 show the present invention applied to a different style of hat, showing a view of the hat in use and at various stages as it is folded up;

FIGS. 11 to 14 show the invention applied to a third type of hat; and

FIGS. 15 to 18 show the invention applied to a fourth type of hat.

DESCRIPTION OF THE PREFERRED EMBODIMENTS

Figure 1:
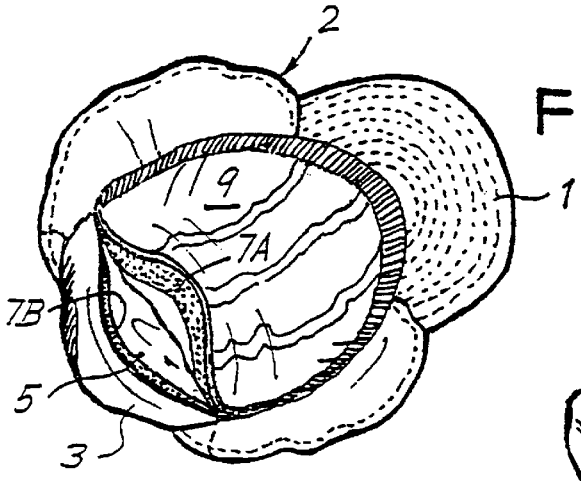
FIGS. 1 to 6 show a first type of hat made according to the invention, in the unfolded state and at various stages as it is folded up.

The invention will first of all be described with reference to the embodiment shown in FIGS. 1–6. FIG. 6 shows the hat 2 in use. It has a peak 1 at the front and a brim 3 at the back. The rear brim 3 contains a pocket 5 which is closed by means of two strips 7A, 7B of adhesive material, such as Velcro®. The strips 7A, 7B are attached along the open edge of the pocket 5, which is formed inside the hat, at the point where the rear brim 3 is stitched to the central part 9 of the hat 2. FIG. 1 shows the hat 2 from below with the pocket 5 open.

Figure 2:
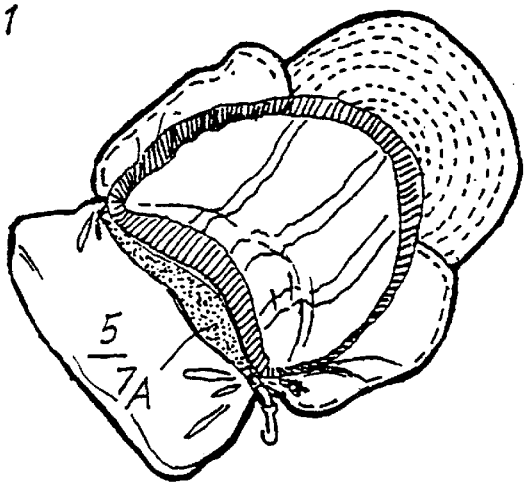
Figure 3:
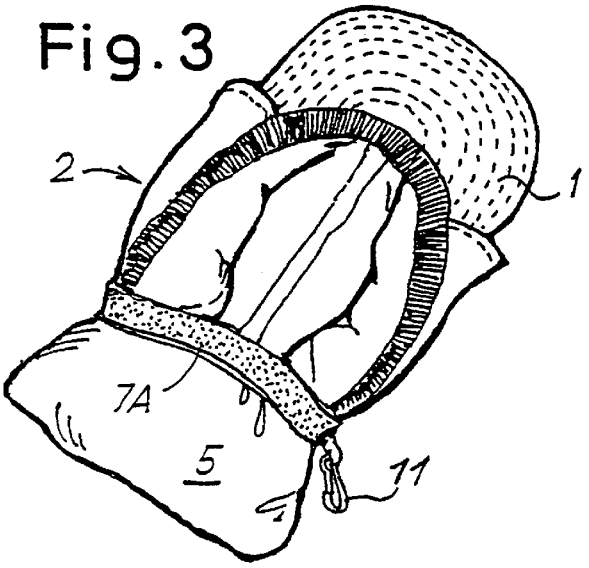
Figure 4:
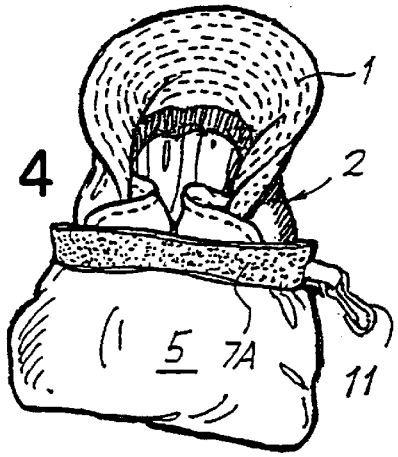

The pocket 5 can be turned inside out as shown in FIG. 2. In the reversed state the pocket 5 can contain the entire hat 2 which is folded up inside it as shown in FIGS. 3 and 4. Once all the hat 2 has been folded up into the reversed pocket 5, the latter can be closed by turning the edges 7A, 7B back in so that they face each other (FIG. 5) and can be fastened together.

Figure 5:
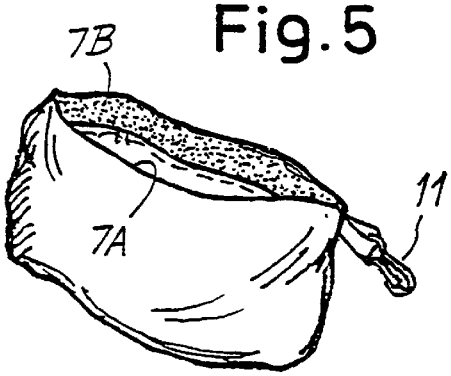
Figure 6:
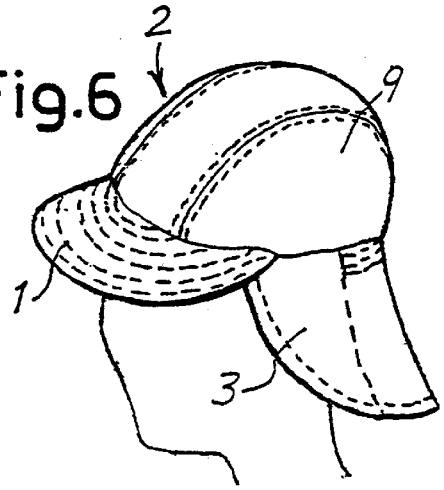

A spring clip or ring 11 can be provided inside the pocket 5 so that, once the hat has been fully folded up into the reversed pocket as shown in FIG. 5, the clip or ring hangs outside the bag formed by the pocket 5 and containing the hat and can, for example, be used to hook the folded hat on to a belt loop or any other suitable place, or can be used to hook a key or other item on to it.

The hat is advantageously made from a very supple and relatively thin material so that it is as compact as possible once it has been folded up into the reversed pocket 5.

When the hat is being worn (FIG. 6) the pocket 5 can be used to store small items such as, for example, personal documents or the like.

The same innovative concept as that illustrated in FIG. 6 can be applied to many different forms of hat. For example, FIGS. 7 to 10 show a hat known as a flat cap, also denoted overall by the reference 2, which has a peak 1 at the front and a pocket 5, closed by means of strips 7A, 7B of adhesive material such as Velcro® or the like, at the back. The pocket 5 opens at the bottom as shown in FIG. 8 and is turned inside out in order to contain the suitably folded hat 2. FIG. 10 shows the fully folded hat inside the pocket 5.

FIGS. 11 to 14 show a hat of roughly circular shape with a wide brim, again denoted by the reference 2. Its central portion contains a pocket 5 which opens on the inside (FIG. 12). By turning the pocket inside out the hat can be folded into it (FIG. 13), thereby reducing it to a small bag (FIG. 14) as in the previous examples.

Lastly, FIGS. 15 to 18 show the invention applied to a fourth type of hat having a peak at the front and a central semicircular body. The pocket 5 opens inside the hat, near the peak at the front (see FIG. 16 which shows the hat from below). FIG. 17 shows the stage in which the hat is inserted into the reversed pocket 5 and FIG. 18 again shows the hat fully folded inside the bag formed by the turned out pocket 5. The references 7A, 7B denote the adhesive closure strips.

The pocket can, of course, be closed using any system that allows reversible and repeated closure; for example, zips, a series of buttons, press studs, or similar means can be used. Indeed, the pocket need not have any closure at all, or it could be closed by means of a foldable flap of fabric, as employed in certain types of pillowcases.

The fabric from which the pocket is made could be of a different colour or type to that of the hat.

While specific embodiments of the invention have been shown and described in detail to illustrate the application of the principles of the invention, it will be understood that the invention may be embodied otherwise without departing from such principles.

What is claimed is:

1. A hat comprising:

an outer layer having a dome shape, said outer layer forming an outer surface of the hat, said outer surface being on a diametrically opposite side of the head of the user when the hat is worn by the user;

a brim connected to said outer layer;

an inner layer having a dome shape and forming an inner surface of the hat, said inner surface being engagable with the head of the user when the hat is worn, said inner and outer layers having a fixed connection area where said inner layer is permanently connected to said outer layer, said inner and outer layers having a releaseable connection area where said inner layer is selectively connectable to said outer layer, said inner and outer layers having a pocket area, said pocket area defining a pocket between said inner and outer layers, said pocket having a shape and size for receiving a remainder of the hat when said pocket area is turned inside out and said remainder area of the hat is folded into said pocket.

2. A hat in accordance with claim 1, wherein:

outer edges of said dome shaped inner and outer layers foam a crown of the hat completely encircling the head of the user, said fixed connection area and said releasable connection area are arranged in said crown of the hat;

said brim is connected to said crown.

3. A hat in accordance with claim 1, wherein:

said inner layer forms an entire interior surface of the hat.

4. A hat in accordance with claim 1, wherein:

said layers are formed of a material for turning said pocket inside out and folding said remainder of the hat inside the pocket.

5. A hat in accordance with claim 1, wherein:

said inner and said outer layers have a substantially consistent thickness across the entire said dome shape.

6. A hat in accordance with claim 2, wherein:

said inner layer forms an entire interior surface of the hat;

said layers are formed of a material for turning said pocket inside out and folding said remainder of the hat inside the pocket;

said inner and said outer layers have a substantially consistent thickness across an entire said dome shape.

* * * * *